US007342478B2

(12) United States Patent
Chan et al.

(10) Patent No.: US 7,342,478 B2
(45) Date of Patent: Mar. 11, 2008

(54) STRUCTURE FOR HIGH VOLTAGE BEARABLE TRANSFORMERS

(75) Inventors: Chun-Kong Chan, Hsi Chih (TW); Jeng-Shong Wang, Taipei County (TW); Chi-Ming Yang, Taipei County (TW); Jin-Jiun Jiang, Taipei County (TW)

(73) Assignee: Lien Chang Electronic Enterprise Co., Ltd., Taipei County (TW)

( * ) Notice: Subject to any disclaimer, the term of this patent is extended or adjusted under 35 U.S.C. 154(b) by 0 days.

(21) Appl. No.: 11/433,450

(22) Filed: May 15, 2006

(65) Prior Publication Data

US 2007/0262843 A1 Nov. 15, 2007

(51) Int. Cl.
*H01F 27/24* (2006.01)

(52) U.S. Cl. ..... 336/212; 336/198; 336/208

(58) Field of Classification Search ..... 336/208, 336/198, 192, 212

See application file for complete search history.

(56) References Cited

U.S. PATENT DOCUMENTS 4,857,876 A * 8/1989 Costa ..... 336/165
6,894,596 B2 * 5/2005 Suzuki ..... 336/83
7,116,201 B2 * 10/2006 Fushimi ..... 336/198

FOREIGN PATENT DOCUMENTS

JP 2006278424 A * 10/2006

* cited by examiner

*Primary Examiner*—Anh Mai
(74) *Attorney, Agent, or Firm*—Rosenberg, Klein & Lee

(57) ABSTRACT

A structure for high voltage bearable transformers is used to electrically connect with backlight driving circuits of liquid crystal display devices. The structure for high voltage bearable transformers is comprised of at least one main bobbin, at least two sets of primary windings, and at least one set of secondary windings. The main bobbin is divided into a primary bobbin and a secondary bobbin. The primary windings are wound on the primary bobbin. The secondary windings are wound on the secondary bobbin. The structure of the high voltage bearable transformer has a tolerance for high voltage, and may connect to several driving units to export several high voltage outputs for driving cold-cathode fluorescent lamps simultaneously.

14 Claims, 7 Drawing Sheets

STRUCTURE FOR HIGH VOLTAGE BEARABLE TRANSFORMERS

BACKGROUND OF THE INVENTION

1. Field of the Invention

The present invention relates to a structure for high voltage bearable transformers, and particularly to a structure for high voltage bearable transformers used to drive the backlight driving circuits of the liquid crystal display devices.

2. Description of Related Art

As liquid crystal display devices like LCD monitors and LCD TVs are increasing in size, liquid crystal display devices need more cold-cathode fluorescent lamps to make the light radiated from the liquid crystal display devices brighter and more uniform.

FIG. 1 shows a conventional structure for a transformer 1, which has two symmetrical main bobbins 11 adjacent to each other. The bobbins include a primary bobbin 12 and a secondary bobbin 13 respectively. There are pins 14 set at the ends of the main bobbins 11. There are several winding troughs 131 and partitions 132 set on the secondary bobbins. Each partition 132 has two winding-cross ditches 133 at two ends of each partition 132. Users may wind the primary windings (not shown in FIG. 1) on the primary bobbins 12 and wind the secondary windings (not shown in FIG. 1) on the secondary bobbins 13. After supplying power, a driving circuit (not shown in FIG. 1) can drive a cold-cathode fluorescent lamp (not shown in FIG. 1) to light as the primary windings connect to the driving circuit and the pins 14 connect to the cold-cathode fluorescent lamp.

Please refer to FIG. 2 that shows the driving manner for conventional transformers. Because there is only one set of primary windings 111, a pair of pins 112, one set of secondary windings 134, and another pair of pins 135 on the magnetic circuit 15, conventional transformers are only able to connect with one driving unit. Because a full-bridge driving unit, a half-bridge driving unit or a push-pull driving unit has been chosen, conventional transformers can't use pair wire coil for lowering the temperature. Subsequently, only a high voltage output may be exported. Moreover, as shown in FIG. 3, this may cause the peak value of the voltage to rise at the high voltage end of conventional transformers causing burn out in the transformers where the secondary windings 134 are coiled on one winding trough 131 of the secondary bobbins 13 and then cross the winding-cross ditches 133 directly and proceed to be wound on the next winding trough 131.

Because conventional transformers can only export a high voltage output to drive a cold-cathode fluorescent lamp, cold-cathode fluorescent lamps must connect to an equal amount of transformers that increases the volume of the liquid crystal display devices and cause transformers to burn out due to a voltage over load. Because conventional transformers have the above mentioned problems, a structure for high voltage bearable transformers that improves upon these problems is desired.

SUMMARY OF THE INVENTION

An object of the present invention is to provide a structure for high voltage bearable transformers, which can connect to several driving units simultaneously and use pair wire coil for lowering the temperature. The design of the magnetic circuit increases the amount of transformers that can simultaneously export numerous high voltage outputs. Moreover, the present invention also raises the voltage tolerance of the transformer and increases the utility rate of the winding area.

To achieve the above objects, the present invention provides a structure for high voltage bearable transformers, which electrically connects to the backlight driving circuits of the liquid crystal display devices. The structure for high voltage bearable transformers is comprised of at least one main bobbin, at least two sets of primary windings and at least one set of secondary windings. The main bobbin has at least two primary bobbins and at least one secondary bobbin. The primary windings are wound on the primary bobbins. The secondary windings are wound on the secondary bobbin. There are several partitions set on the secondary bobbin to form several winding troughs. There is one more partition set on the secondary bobbin at each high voltage end of the transformer to form a separation. The transformer connects to two driving units by two sets of primary windings and decreases the peak value of the voltage of the windings, which are formed by the secondary windings in the winging troughs.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
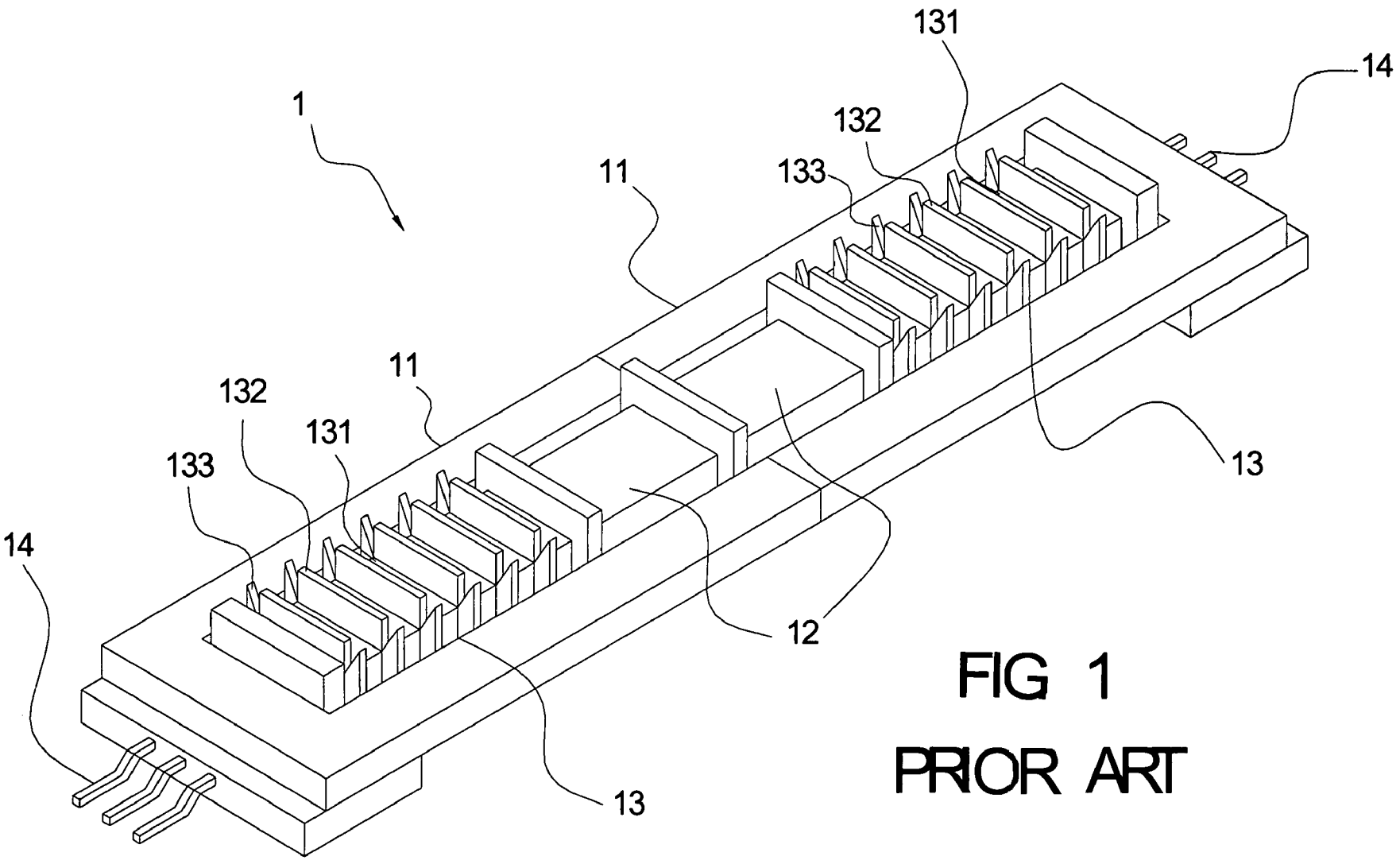
FIG 1 PRIOR ART
FIG. 1 is a perspective view of a structure of a conventional transformer.
Figure 2:
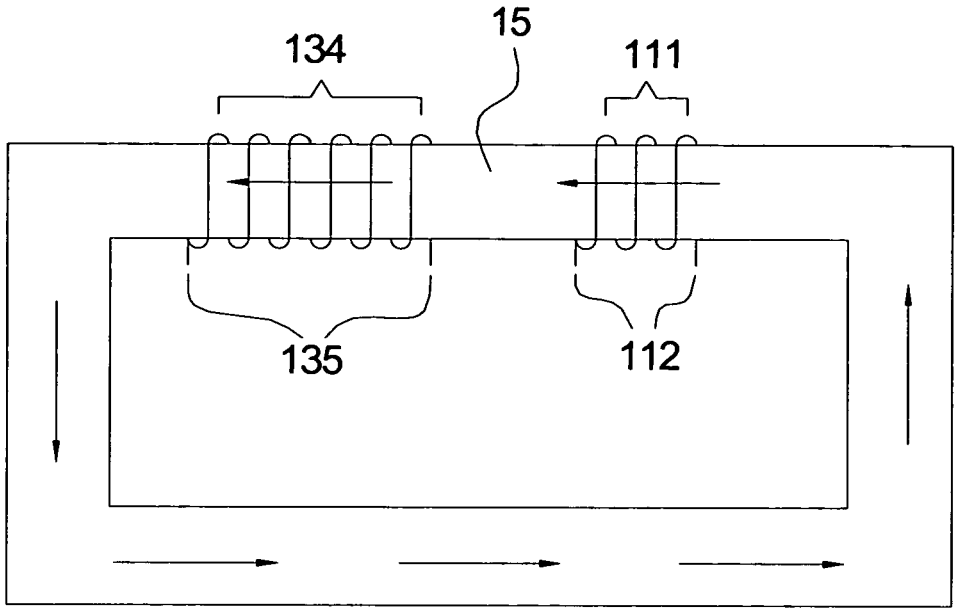
FIG 2 PRIOR ART
FIG. 2 is a schematic diagram of the driving manner of a conventional transformer.
Figure 3:
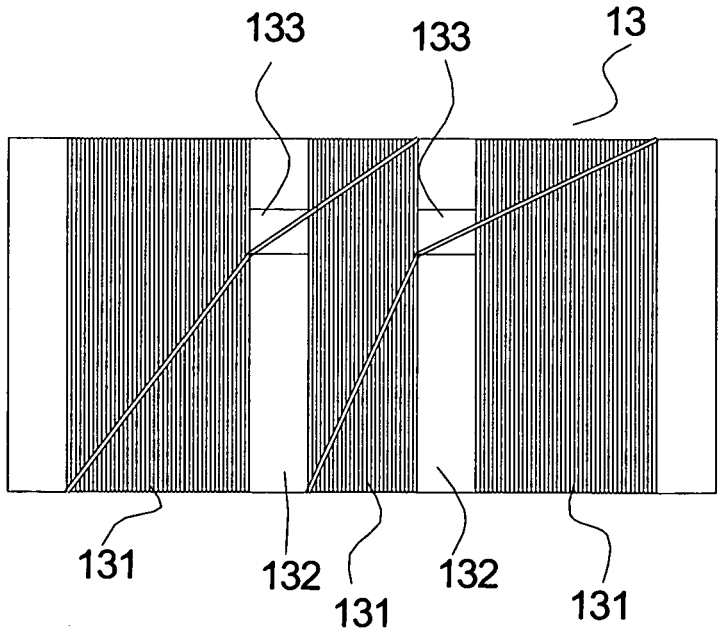
FIG 3 PRIOR ART
FIG. 3 is a schematic diagram of the winding of a conventional transformer.
Figure 4:
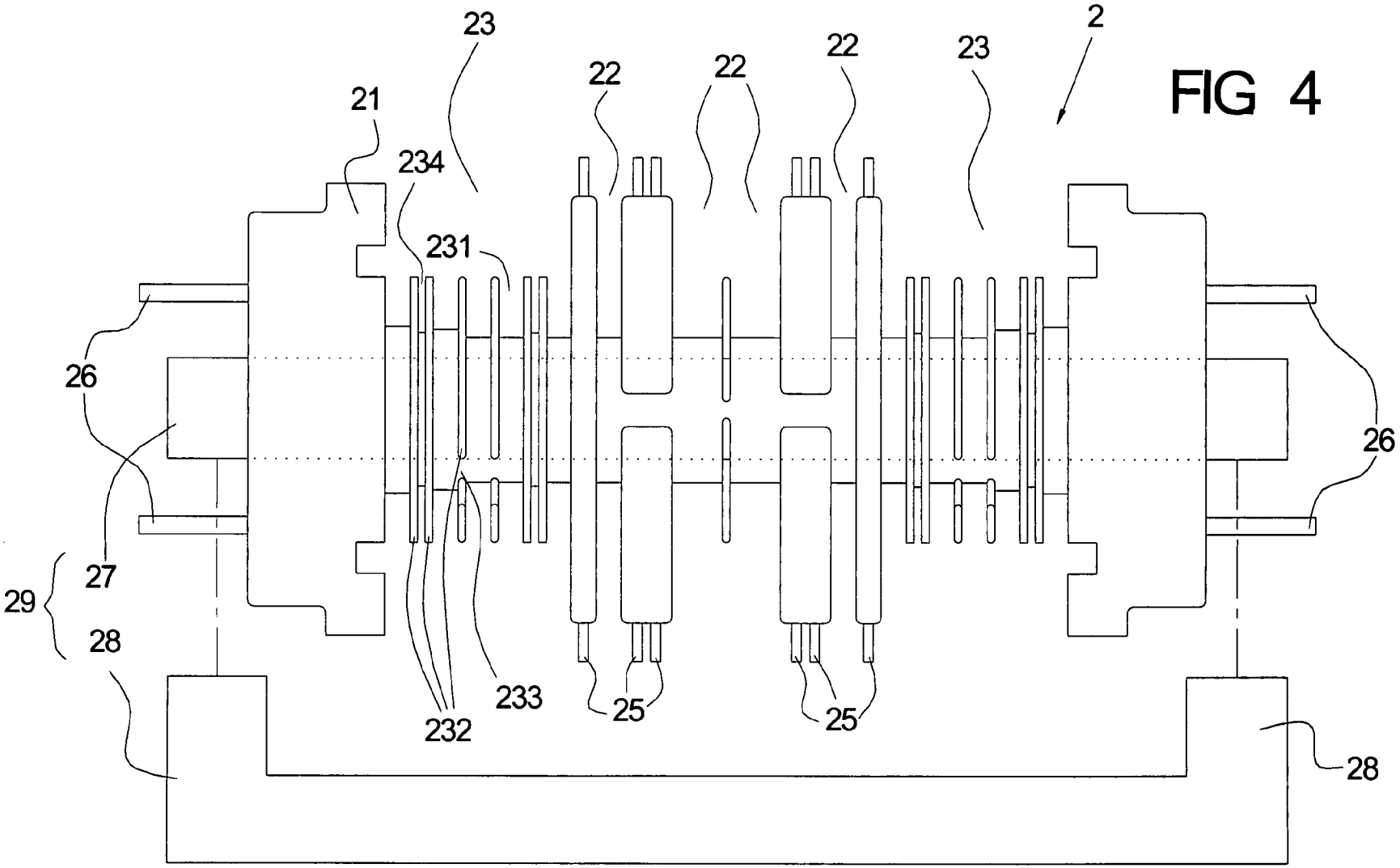
FIG. 4 is a schematic diagram of a structure of a high voltage bearable transformer of the present invention.

Referring to FIG. 4, the present invention provides a structure of a high voltage bearable transformer 2, which can be used to electrically connect to backlight driving circuits of liquid crystal display devices, is comprised of at least one main bobbin 21. In the first embodiment, the structure of the high voltage bearable transformer 2 is constructed from two bobbins 21 that are symmetrically coupled or form with a one-shot design. There are at least two primary bobbins 22 and at least one secondary bobbin 23 on the main bobbin 21. There are a plurality of primary pins 25 extending from the main bobbin 21 near the primary bobbins 22, and two sets of secondary pins 26 extending from two ends of the main bobbin 21 respectively. The structure of the high voltage bearable transformer 2 further comprises an I-type core 27 and a U-type core 28 set through the main bobbin 21 to form a magnetic circuit 29.

The secondary bobbin 23 divides into a plurality of winding troughs 231. These winding troughs 231 are separated from a plurality of partitions 232 disposed on the secondary bobbin 23. Each partition 232 has a winding-cross ditch 233 that a coiling wire is wound around again at the next winding trough 231 after crossing a winding-cross ditch 233. Moreover, another partition 232 forms a separation 234 and one more partition 232 is set near the other partition 232 on the high voltage end of the winding trough 231.

The primary bobbin 22 and the secondary bobbin 23 are wound around an equal or unequal number of coils to transform voltages or to transform direct currents into alternating currents. The primary pins 25 are used to connect to at least one driving unit (not shown in figures). The secondary pins 26 are used to output electrical power as well as to connect to cold-cathode fluorescent lamps (not shown in figures). The winding troughs 231 of the secondary bobbin 23 are used to wind windings to form winding assemblies, and these winding assemblies are isolated by the partitions 232.

Figure 5:
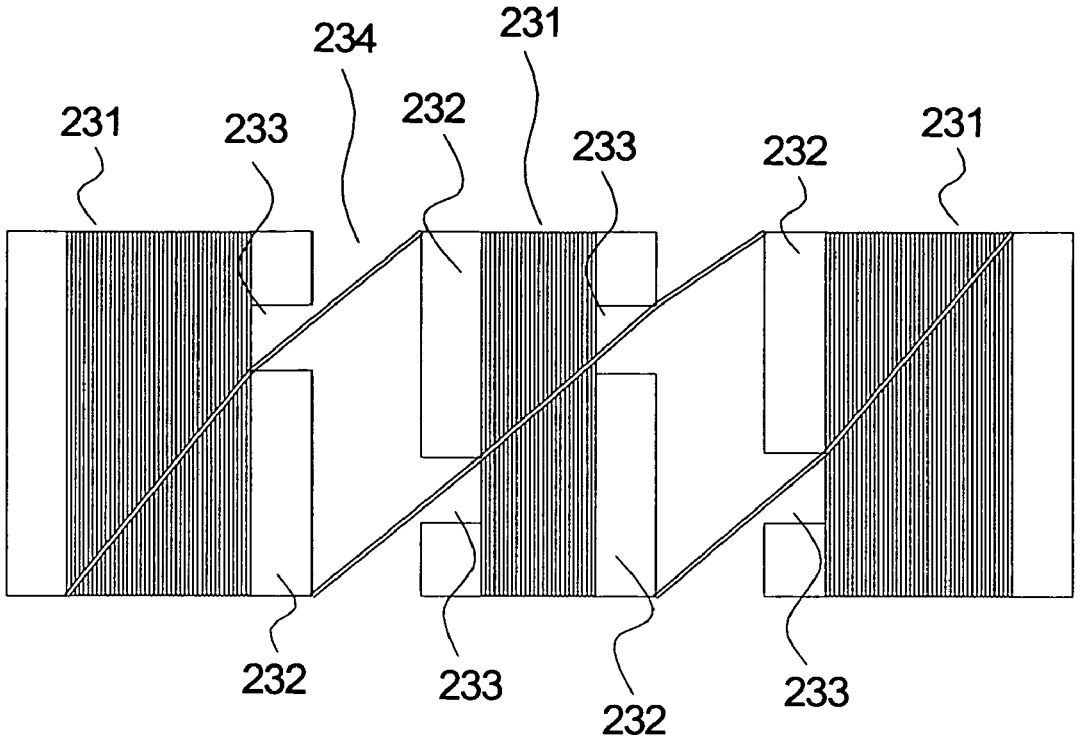
FIG. 5 is a schematic diagram of the winding of the high voltage bearable transformer of the present invention.

As shown in FIG. 5, each of the winding-cross ditches 233 on the secondary bobbin 23 of the structure of the high voltage bearable transformer 2 are staggeredly set on each partition 232. Two neighboring partitions 232 are set near the winding trough 231 at the high voltage end to form a separation 234. Thus, the design of the present invention decreases the contact area between the two windings wound on both the winding troughs 231 that are near each other. Furthermore, the design also reduces the peak value of the voltage so as to increase an insulating effect.

Figure 6:
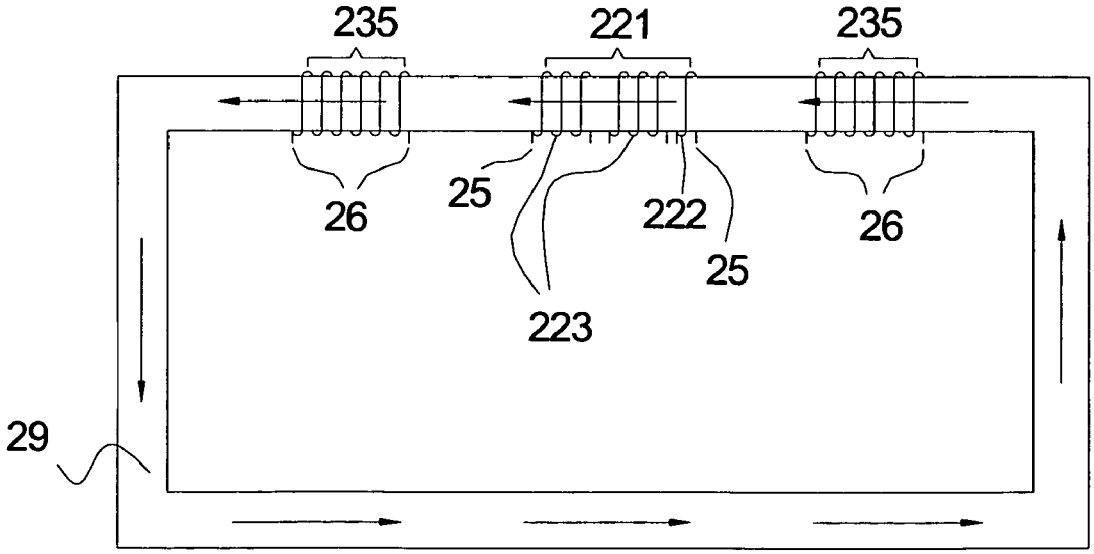
FIG. 6 is a schematic diagram of a first driving manner of the present invention.

A driving way for a ROYER circuit is shown in FIG. 6. The driving way includes a primary windings set 221 which is constructed from one set of balance windings 222, two sets of primary windings 223, and two sets of secondary windings 235. The primary windings set 221 and the two sets of secondary windings 235 make a loop on the magnetic circuit 29. The primary windings set 221 is connected to the driving unit, i.e. the ROYER driving unit. The two sets of secondary windings 235 are connected to a cold-cathode fluorescent lamp. As electrical power is transmitted to the primary windings set 221 via the ROYER driving unit, the magnetic circuit 29 generates a magnetic current that is due to the electric current passing through the primary windings set 221, and then the magnetic current passes through the winding place of the two sets of secondary windings 235 to make the two sets of secondary windings 235 generate current from the induced magnetic current to drive the cold-cathode fluorescent lamps. The set of balance windings 222 is used to stabilize the currents induced from the two sets of secondary windings 235.

Referring to FIGS. 7 to 10, the structure of the high voltage bearable transformer 2 of the present invention can accomplish requests for different outputs to drive by varying the disposition of the primary bobbins 22, the secondary bobbins 23, and the magnetic circuit 29.

Figure 7:
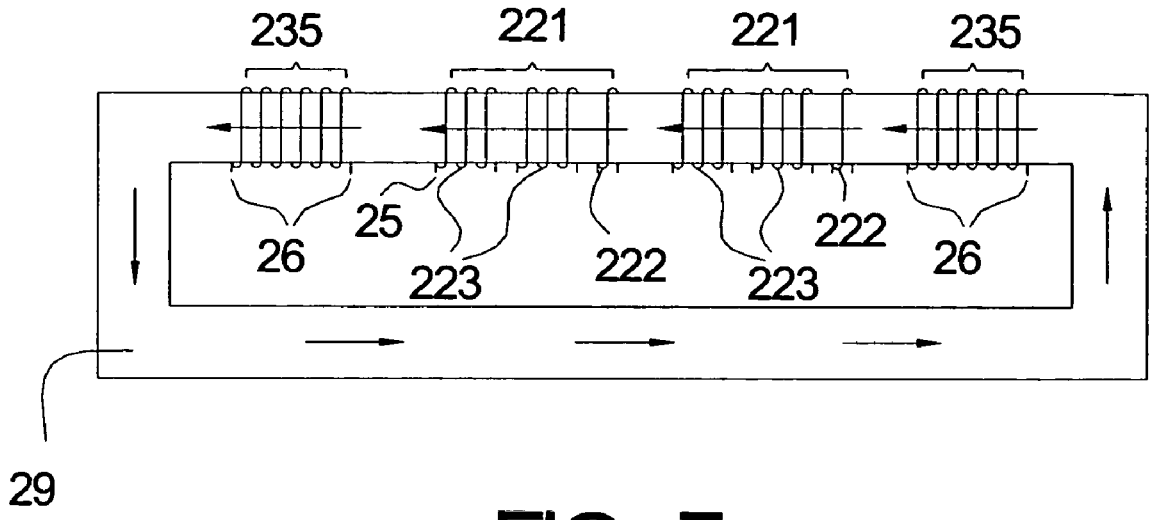
FIG. 7 is a schematic diagram of a second driving manner of the present invention.

As shown in FIG. 7, the structure for high voltage bearable transformers of the present invention comprises two primary windings sets 221 and two sets of secondary windings 235 connected to two ROYER driving units. Each primary winding set 221 includes two sets of primary windings 223 and a set of balance windings 222 electrically connected to a ROYER driving unit with primary pins 25. Each set of secondary windings 235 is connected to a cold-cathode fluorescent lamp with the secondary pins 26. This driving manner also can drive two cold-cathode fluorescent lamps and the currents of the cold-cathode fluorescent lamps are more stable.

Figure 8:
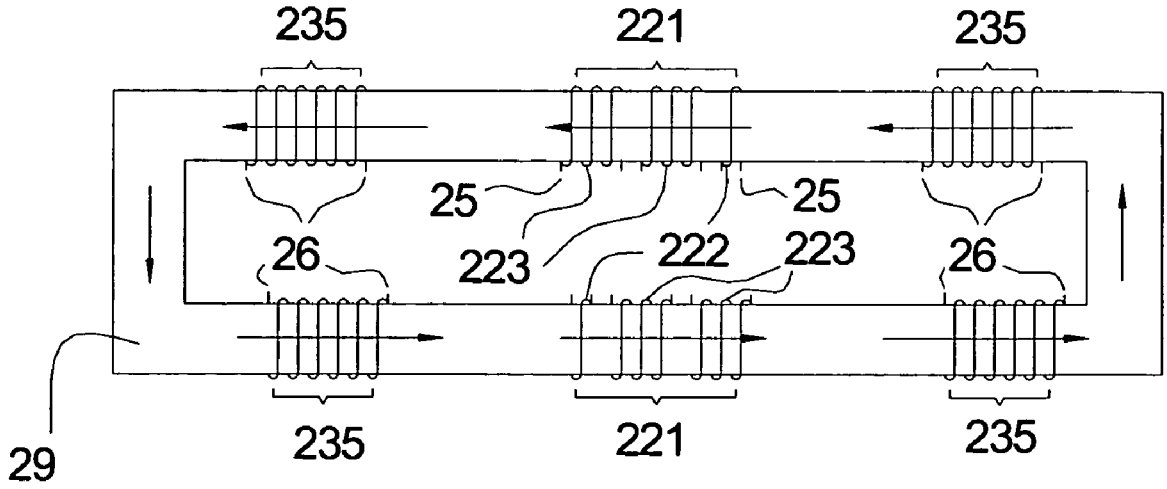
FIG. 8 is a schematic diagram of a third driving manner of the present invention.

As shown in FIG. 8, it comprises two primary windings sets 221 and four sets of the secondary windings 235 to connect two ROYER driving units also. Both ROYER driving units drive two cold-cathode fluorescent lamps that one primary windings set 221 and two sets of the secondary windings 235 make a set and series connection, therefore, this driving manner can drive four cold-cathode fluorescent lamps simultaneously.

Figure 9:
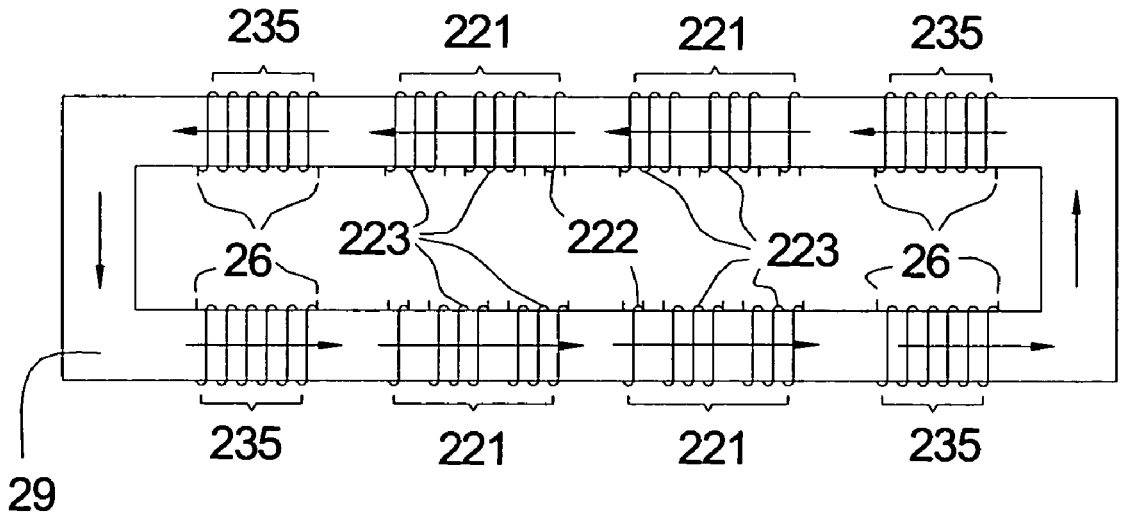
FIG. 9 is a schematic diagram of a fourth driving manner of the present invention.

As shown in FIG. 9, it also can drive four cold-cathode fluorescent lamps simultaneously. However, there are four primary windings sets 221 and each connects electrically to a ROYER driving unit that drives four cold-cathode fluorescent lamps simultaneously and the currents of the cold-cathode fluorescent lamps are more stable.

Figure 10:
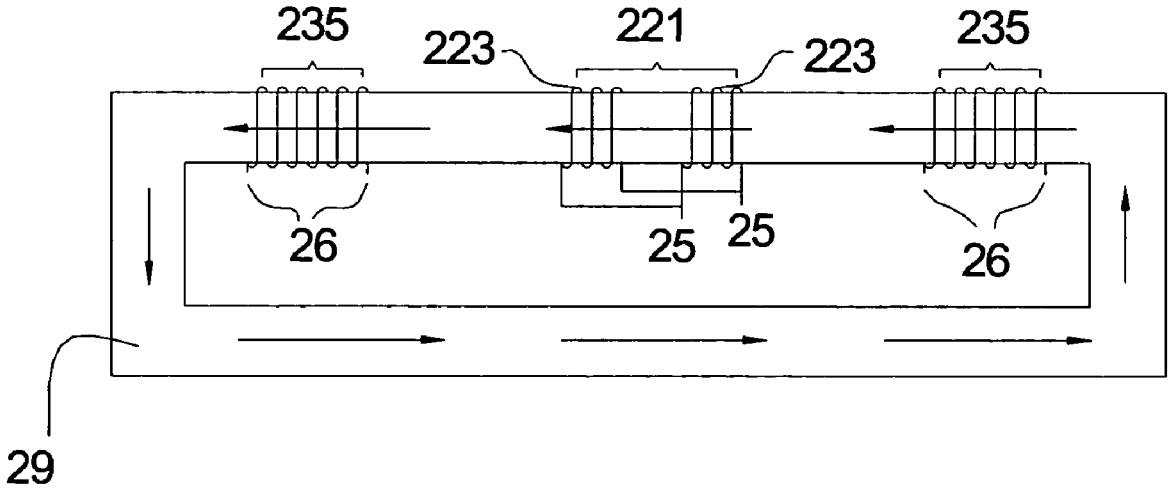
FIG. 10 is a schematic diagram of a fifth driving manner of the present invention.

Referring to FIG. 10, in this embodiment, the present invention comprises a primary windings set 221, which is constructed from the two sets of primary windings 223, and the two sets of secondary windings 235. The sets of primary windings 223 use pair wire coil for electrically connecting to a driving unit. The driving unit can be a full-bridge driving unit, a half-bridge driving unit, or a push-pull driving unit. If the driving unit is a push-pull driving unit, four primary pins 25 of the sets of the primary windings 223 connect to the n-channel MOSFETs at the current export end and the other end of the push-pull driving unit respectively. The primary pins 25 at the two import ends of the sets of the primary windings 223 electrically connect together to the n-channel MOSFET at the current export end of the push-pull driving unit, and the primary pins 25 at the two export ends of the sets of the primary windings 223 electrically connect together to the other n-channel MOSFET. The pair wire coil reduces a skin effect and lower the temperature of the sets of the primary windings 223.

It can be known from the abovementioned description that the present invention can achieve requests for numerous sets of outputs to drive a plurality of cold-cathode fluorescent lamps simultaneously. The invention can be used for various driving units and reduces the skin effect via pair wire coil. Thus, the invention has wider applications.

Figure 11:
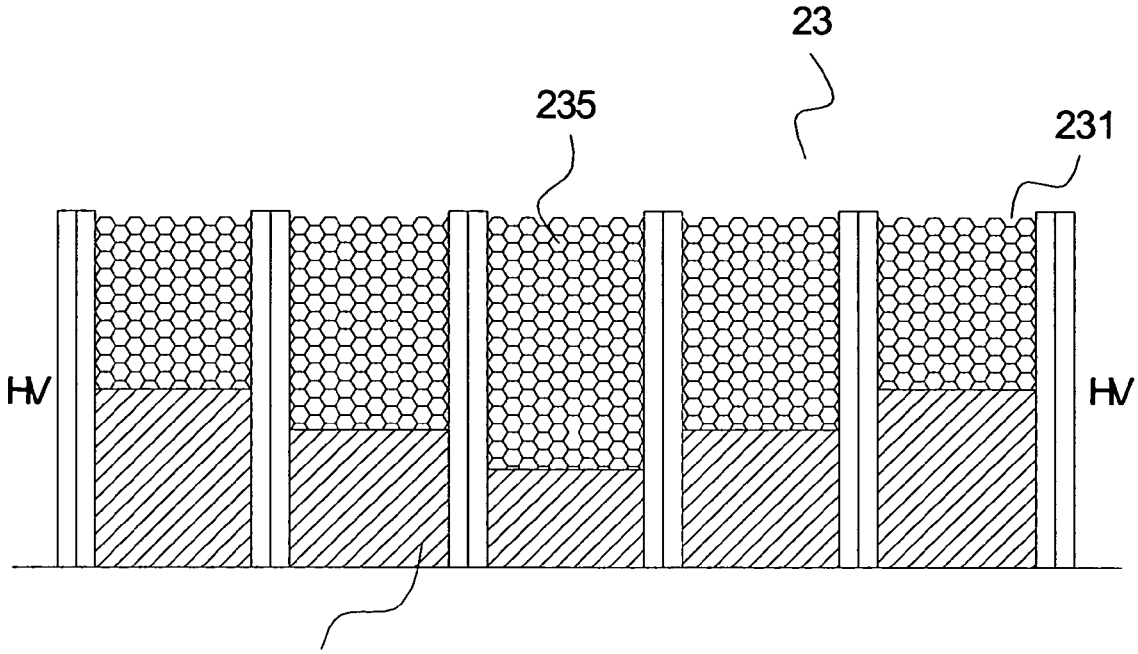
FIG. 11 is a schematic diagram of a first disposition of the thickness of the wall of the present invention.
Figure 12:
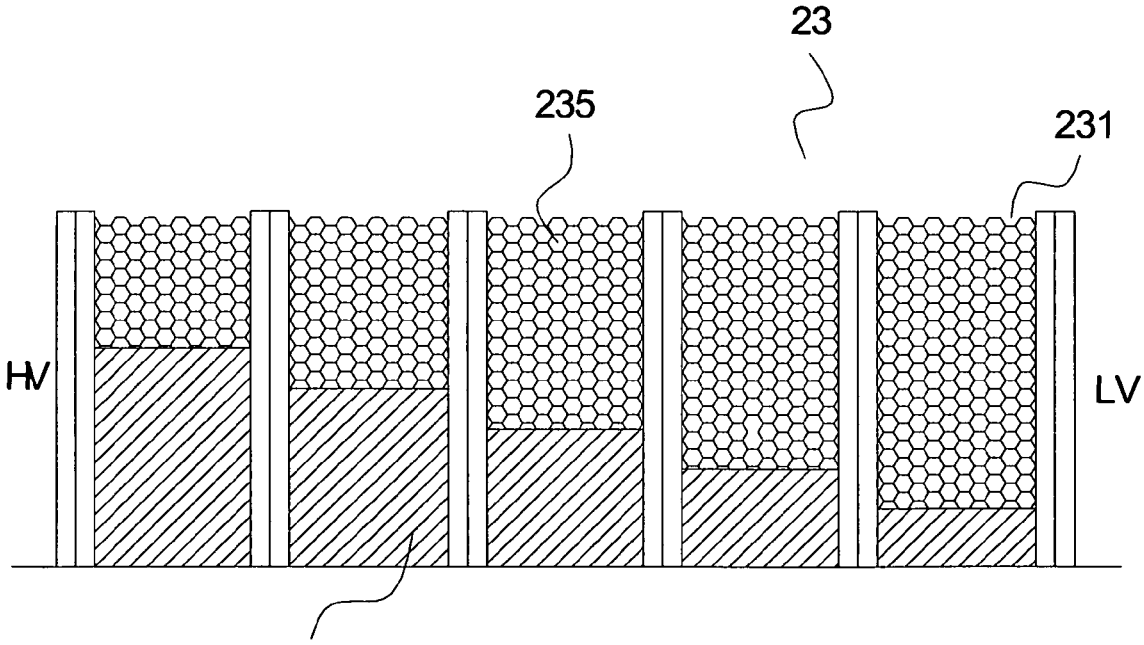
FIG. 12 is a schematic diagram of a second disposition of the thickness of the wall of the present invention.

As shown in FIGS. 11 and 12, the thickness of the wall of the bottoms 236 of the winding troughs 231 of the secondary bobbins 23 of the structure for high voltage bearable transformers 2 can be disposed diversely according to changes in voltage. In principle, the thickness of the wall of the bottoms 236 of the winding troughs 231 at the higher voltage end is thicker, and the thickness of the wall of the bottoms 236 of the winding troughs 231 at the lower voltage end is thinner. If the two ends of the secondary bobbin 23 are the high voltage end (FIG. 11), the thickness of the wall of the bottoms 236 of the winding trough 231 at the two ends is thicker, and the thickness of the wall of the bottoms 236 is decreased as the bottoms 236 between the two ends are close to the center, and the thickness of the wall of the bottoms 236 in the center is thinnest. If one end is the high voltage end and the other end is the low voltage end, the thickness of the wall of the bottoms 236 is increased along the low voltage end to the high voltage end. In another words, the thickness of the wall of the bottoms 236 at the low voltage end is thinnest, and the thickness of the wall of the bottoms 236 at the high voltage end is thickest. Thus, it may augment the tolerance for voltage and increase the utility rate of the area for winding to achieve the object of high voltage bearing.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to embrace within the scope of the invention as defined in the appended claims.

What is claimed is:

1. A structure for high voltage bearable transformers which electrically connects with backlight driving circuits of liquid crystal display devices, comprising:

at least one main bobbin, which includes at least two primary bobbins and at least one secondary bobbin, having a first bottom wall thickness at a high voltage end and a second bottom wall thickness at a low voltage end, said first bottom wall thickness of said secondary bobbin being greater than said second bottom wall thickness;

at least two sets of primary windings, which are wound on the primary bobbins of the main bobbin respectively; and at least one set of secondary windings, which are wound on the secondary bobbin of the main bobbin.

2. The structure for high voltage bearable transformers as claimed in claim 1, wherein the main bobbin couples symmetrically or forms a one-shot design with two bobbins which are the same as each other.

3. The structure for high voltage bearable transformers as claimed in claim 1, wherein there are a plurality of partitions set on the secondary bobbin to form a plurality of winding troughs on the secondary bobbin.

4. The structure for high voltage bearable transformers as claimed in claim 3, wherein each of the partitions has a winding-cross ditch.

5. The structure for high voltage bearable transformers as claimed in claim 4, wherein these winding-cross ditches are staggeredly set on the partitions.

6. The structure for high voltage bearable transformers as claimed in claim 3, wherein the secondary bobbin has one more partition set near by another partition at each of a set of high voltage ends of the transformers to form a separation.

7. The structure for high voltage bearable transformers as claimed in claim 1, wherein the sets of primary windings constitute a primary windings set.

8. The structure for high voltage bearable transformers as claimed in claim 7, wherein the primary windings set connects to a driving unit.

9. The structure for high voltage bearable transformers as claimed in claim 8, wherein the driving unit is a push-pull driving unit, a full-bridge driving unit, or a half-bridge driving unit.

10. The structure for high voltage bearable transformers as claimed in claim 9, wherein the primary windings set uses pair wire coil for connecting to the push-pull driving unit, the full-bridge driving unit, or the half-bridge driving unit.

11. The structure for high voltage bearable transformers as claimed in claim 7, wherein the primary windings set further includes a set of balance windings to connecting a ROYER driving unit.

12. The structure for high voltage bearable transformers as claimed in claim 1, further comprises at least two cores set through the main bobbin.

13. The structure for high voltage bearable transformers as claimed in claim 12, wherein the cores form a magnetic circuit.

14. The structure for high voltage bearable transformers as claimed in claim 13, wherein there are a plurality sets of primary windings and a plurality of sets of secondary windings set on the magnetic circuit.

* * * * *